US009850097B2

(12) United States Patent
Lustenberger et al.

(10) Patent No.: US 9,850,097 B2
(45) Date of Patent: Dec. 26, 2017

(54) MONITORING DEVICE FOR A PASSENGER TRANSPORT SYSTEM

(71) Applicant: Inventio AG, Hergiswil (CH)

(72) Inventors: Ivo Lustenberger, Buttisholz (CH); Astrid Sonnenmoser, Hochdorf (CH)

(73) Assignee: INVENTIO AG, Hergiswil (CH)

( * ) Notice: Subject to any disclaimer, the term of this patent is extended or adjusted under 35 U.S.C. 154(b) by 367 days.

(21) Appl. No.: 14/651,850

(22) PCT Filed: Dec. 2, 2013

(86) PCT No.: PCT/EP2013/075252

§ 371 (c)(1),
(2) Date: Jun. 12, 2015

(87) PCT Pub. No.: WO2014/090623

PCT Pub. Date: Jun. 19, 2014

(65) Prior Publication Data

US 2015/0307326 A1 Oct. 29, 2015

(30) Foreign Application Priority Data

Dec. 13, 2012 (EP) ..... 12196942

(51) Int. Cl.

| | |
|---|---|
| ***B66B 13/22*** | (2006.01) |
| ***B66B 1/28*** | (2006.01) |
| ***B66B 5/00*** | (2006.01) |
| ***B66B 29/00*** | (2006.01) |

(52) U.S. Cl.

CPC ..... *B66B 13/22* (2013.01); *B66B 1/28* (2013.01); *B66B 5/0031* (2013.01); *B66B 29/00* (2013.01)

(58) Field of Classification Search

CPC ..... B66B 13/22; B66B 1/28; B66B 5/0031; B66B 29/00

USPC ..... 187/393

See application file for complete search history.

(56) References Cited

U.S. PATENT DOCUMENTS

| | | | | |
|---|---|---|---|---|
| 4,785,914 | A * | 11/1988 | Blain | B66B 1/24 187/280 |
| 2002/0166732 | A1* | 11/2002 | Horbrugger | B66B 13/22 187/393 |
| 2004/0173410 | A1* | 9/2004 | Deplazes | B66B 13/22 187/247 |
| 2004/0178024 | A1* | 9/2004 | Deplazes | B66B 5/02 187/394 |

(Continued)

FOREIGN PATENT DOCUMENTS

| | | | |
|---|---|---|---|
| CN | 102227367 | A | 10/2011 |
| EP | 2452907 | A1 | 5/2012 |

(Continued)

*Primary Examiner* — David Warren

(74) *Attorney, Agent, or Firm* — William J. Clemens; Shumaker, Loop & Kendrick, LLP

(57) ABSTRACT

A monitoring device for passenger transport systems, which systems are designed as elevators, escalators or moving walkways, includes at least one detecting device used to detect an external actuation of an equipment of the passenger transport system, a control device and at least one energy store for storing electrical energy. The energy store is kept in a charged state. The energy store is put into a discharged state when the detecting device detects the external activation of the equipment.

15 Claims, 2 Drawing Sheets

(56) References Cited

U.S. PATENT DOCUMENTS

| | | | | |
|---|---|---|---|---|
| 2006/0051189 | A1* | 3/2006 | Sekimoto | B66B 5/0031 414/277 |
| 2009/0255762 | A1* | 10/2009 | Ketonen | B66B 13/22 187/247 |
| 2009/0321192 | A1* | 12/2009 | Kattainen | B66B 5/0056 187/279 |
| 2011/0272216 | A1* | 11/2011 | Kugiya | B66B 13/22 187/301 |
| 2012/0118675 | A1* | 5/2012 | Abad | B66B 13/22 187/288 |
| 2013/0081906 | A1* | 4/2013 | Studer | B66B 13/22 187/325 |
| 2015/0307326 | A1* | 10/2015 | Lustenberger | B66B 13/22 187/393 |

FOREIGN PATENT DOCUMENTS

| | | | |
|---|---|---|---|
| JP | 2004505868 | A | 2/2004 |
| TW | 201002603 | A | 1/2010 |
| TW | 201213222 | A | 4/2012 |
| WO | 0212109 | A1 | 2/2002 |

* cited by examiner

MONITORING DEVICE FOR A PASSENGER TRANSPORT SYSTEM

FIELD

The invention relates to a monitoring device for transport systems for persons, which systems are designed as elevators, escalators or moving walkways, to such a passenger transport system and to a method for such a passenger transport system. The invention especially relates to the field of elevator systems.

BACKGROUND

A monitoring device for an elevator is known from WO 02/12109 A1. The known monitoring device comprises a number of contactlessly actuable switching devices which are serially connected together to form a safety circuit. The switching devices have to have a specific state in order to be able to safely perform an intended action. In particular, in normal operation it has to be ensured in the case of an elevator system that all doors remain closed and mechanically locked when an elevator car of the elevator system moves. If the elevator car does not move, then a shaft door may be opened only if the elevator car is present at this shaft door. In the case of the known monitoring device each switching devices comprises an active unit and a passive unit, wherein the active unit and the passive unit are so constructed that the passive unit is excited exclusively by a pattern generated by the active unit. The active unit is in this regard constructed as an interrogation unit. The passive unit is constructed as a response unit. The interrogation unit is in that case so constructed that it is in a position of transferring data to the response unit and receiving data from the response unit. A first coil of the interrogation unit and a second coil of the response unit are constructed as antennae. The interrogation unit transmits energy to the response unit by way of an electromagnetic field. This is carried out by an electromagnetic coupling, since the energy transmission functions similarly to a transformer where the energy is transferred from the primary winding to the secondary winding through a narrow coupling. The energy coupled in by way of the electromagnetic field is temporarily stored by the response unit in an energy store. As soon as the response unit has received sufficient energy it is functionally capable and responds in a very specific mode and manner to the pattern generated by the interrogation unit.

The monitoring unit known from WO 02/012109 A1 has the disadvantage that the interrogation unit has to be permanently supplied with electrical energy by an energy supply, for example a supply mains. If, for example, this energy supply occasionally fails or an energy transmission to the interrogation unit for the monitoring unit is disturbed then the monitoring device is no longer functionally capable, since due to the absence of energy a charging of the energy store of the passive unit then cannot take place by way of the active unit. It thus can no longer be recognized whether a door is open. If the door is closed again during the power failure, such a possible action remains unrecognized.

SUMMARY

An object of the invention is to indicate a monitoring device for transport systems for persons, which systems are designed as elevators, escalators or moving walkways, as well as such a passenger transport system and a method for monitoring such a passenger transport system, which are of improved design. Specifically, it is an object of the invention to indicate a monitoring device for transport systems for persons, which systems are designed as elevators, escalators or moving walkways, as well as such a passenger transport system and a method for monitoring such a passenger transport system in which external actuation of an device of the passenger transport system can be detected even during occasional interruption of an external energy supply.

The object is fulfilled by a monitoring device for transport systems, which are designed as elevators, escalators or moving walkways, for persons. The monitoring device comprises at least one detecting device, which serves for detection of external actuation of an device of the passenger transport system, and at least one energy store for storage of electrical energy. By "external actuation" there is to be understood actuation of the device which is attributable to an external action and does not take place, for example, due to a control signal of a control device of the passenger transport system. Such external actuations can be, for example, opening of the shaft doors by a person, which by means of a box spanner creates access to the elevator shaft. Other external actuations are also conceivable, for example if a shaft door has been forcibly opened or pushed in.

The energy store can be kept in a charged state independently of an external energy supply which is present. The detecting device detects external actuation of the device in that the energy store after external actuation of the device is transferred to a discharged state. The state of the energy store can be interrogated by suitable means, for example by the control device of the passenger transport system. A discharged state of the energy store always represents an external actuation and this is so even if the device itself has re-adopted its original start state. The original start state is that physical state which the device has before the external actuation thereof has taken place. In the case of a shaft door this would be, for example, the closed state thereof. Even if the energy store is defective, due to the discharged state an external actuation is assumed and the passenger transport system then has to be checked by an expert. Only an intentional resetting or charging of the energy store erases the information that external actuation has taken place.

The object is additionally fulfilled by a passenger transport system with at least one monitoring device and by a method for monitoring a passenger transport system with at least one monitoring device.

It is advantageous that in the case of interruption of the external energy supply the energy store is transferred to a discharged state if the detecting device detects external actuation of the device and that the control device after the interruption switches the external energy supply to the special operating state if the energy store is in the discharged state. The monitoring device is distinguished by a special utilization or circuitry of the energy store for storage of electrical energy. If the external energy supply is available, then the energy store is not absolutely necessary for detection of external actuation of the device of the passenger transport system, since detection of external actuation can be communicated to the control device in conventional manner, for example by way of a bus system. If, thereagainst, the external energy supply is interrupted then the state of the energy store can be manipulated in dependence on detection of external actuation. If during the interruption the external energy supply does not detect external actuation then the energy store remains charged. If on the other hand external actuation of the device of the passenger transport system is detected during interruption of the external energy supply the energy store is then manipulated and transferred to an uncharged state. After the interruption of the external energy supply the state of the energy store can then be interrogated, for example within the scope of an initialization procedure. The state of the energy store now indicates whether or not during interruption of the external energy supply external actuation of the device of the passenger transport system took place. If external actuation did not take place, the control device then switches to the special operating state.

However, in one possible design of the monitoring device or the transport equipment for persons or the method the energy store can be used, even when the external energy supply is intact, in order to establish that external actuation of the device has taken place. In this case the energy store cannot be transferred, even in the power-free state of the external energy supply, to the discharged state if external actuation of the monitored device is detected. This can also be carried out additionally to a further safety circuit and/or a further safety device. A redundant monitoring and/or interrogation is therefore possible. The energy store can thus also be used in such a case as a status store. In this regard it is advantageous that the control device switches to the special operating state if the energy store is in the discharged state. In addition, the control device can, even when the external energy supply is present, also directly switch to the special operating state if the detecting device detects external actuation of the device.

By "charged state of the energy store" and "uncharged state of the energy store" there are to be understood two states of the energy store different from one another. A charged state is in that regard not necessarily a fully charged state. In particular, during the interruption of the external energy supply a slight discharging can also occur due to constructional reasons. In addition, a maximum possible charging of the energy store can also vary as a consequence of component tolerances or component ageing. Moreover, the energy store even in the discharged state can still carry a residual charge, since complete discharging is in a given case not necessary for distinction of the states and also in a given case for constructional reasons is too complicated or lasts too long. What is essential is a reliable differentiation of the charged state of the energy store from the discharged state of the energy store.

It is advantageous that at least one threshold value for the energy store is present, that when an external energy supply is present the energy store can be transferred to a charged state in which the charge of the energy store is greater than the at least one threshold value and that in the case of interruption of the external energy supply the energy store is transferred to a discharged state in which the charge of the energy store is smaller than the at least one threshold value if the detecting device detects external actuation of the device of the passenger transport system. Specifically, an upper threshold value and a lower threshold value for the energy store can be preset, wherein the upper threshold value is greater than the lower threshold value. In this case the energy store is charged above the upper threshold value so that it is in the charged state. In addition, the energy store is discharged to below the lower threshold value so that it is in the discharged state. In that case, a sufficient separation and thus a capability of differentiating the states is guaranteed by way of the spacing between the lower threshold value and the upper threshold value.

It is also advantageous that the control device, when the external energy supply is present, transfers the energy store from the discharged state to the charged state only if the detecting device does not detect external actuation of the device. If at this point in time external actuation of the device is still present, then resetting is prevented. This is feasible for, for example, the possibility of automatic resetting which depends on further conditions.

Additionally or alternatively it is of advantage that the control device, when the external energy supply is present, transfers the energy store from the discharged state to the charged state only if the control device blocks transport of persons by the passenger transport system in the special operating state and manual release takes place. Automatic resetting is not possible in this case. The manual release can in that regard be reserved to, for example, an authorized service operative. For example, it is conceivable with an elevator system that external actuation of an elevator door is monitored at a floor. If during interruption of the external energy supply this floor door has been opened and closed again then a person is possibly still present in the elevator shaft. Thus, the elevator system is blocked at the outset. This applies correspondingly to an escalator or a moving walkway when, for example, a cover to an engine compartment is opened and this cover is monitored by means of a monitoring device according to the invention.

It is also advantageous that the detecting device comprises a switching element which is mechanically actuable at least indirectly by the device of the passenger transport system and which can be actuated for detecting the external actuation and that in the case of the switching element being actuated a current circuit for discharging the energy store is closed. The mechanically actuable switching element can be constructed as, for example, a button. The components for discharging the energy store, which are present in the current circuit, are in that case so dimensioned that a sufficiently rapid discharging of the energy store is guaranteed. A simple mechanical activation is thus possible. The switching element can thus be designed as, in particular, a passive switching element. It is thereby possible to dispense with a local energy supply.

In that case, a particular advantage of the invention is that the monitoring device is not capable of simple manual manipulation, for example by jamming the button, as was done impermissibly on rare occasions and has led to serious accidents. The discharged energy store 'stores' the actuation of the device permanently and firstly has to be charged again so that the passenger transport system can be returned to the normal operating state.

However, it is also advantageous that the detecting device comprises an active switching element which is electrically, electronically or electromagnetically actuable at least indirectly by the device of the passenger transport system and which can be actuated for detecting the external actuation, and that when the switching element is actuated a current circuit for discharging the energy store is closed. In that case, in particular, a contactless detection of external actuation of the device of the passenger transport system can also be realized. Moreover, through a circuit construction with the active switching element it is possible to achieve a reliable and substantial discharging of the energy store. For example, the discharging can also take place over a comparatively long period of time even if the activation takes place only briefly. Moreover, the monitoring can thereby be designed to be more complex and, for example, be designed to be insensitive relative to artifacts (an unreal result caused by the method or the effects of a system weakness on a useful signal in measuring, signalling or similar technology) and an external manipulation.

In that case, the active switching element or an active interrogation unit can be supplied with energy by a switching element at least in part from the energy store. Additionally or alternatively an independent energy source, particularly a battery or an accumulator, can also be provided, which is independent of the external energy supply, wherein the active switching element is supplied with energy at least in part by the independent energy source. In particular, the independent energy source can ensure energy supply of the active switching element only in the case of interruption of the external energy supply.

For reasons of redundancy a design is also conceivable in which not only a passive switching element, but also an active switching element or an active interrogation unit are provided with a switching element for detecting external actuation of the same device of the passenger transport system.

DESCRIPTION OF THE DRAWINGS

Preferred embodiments of the invention are explained in more detail in the following description by way of the accompanying drawings, in which corresponding elements are provided with corresponding reference symbols and in which.

DETAILED DESCRIPTION

Figure 1:
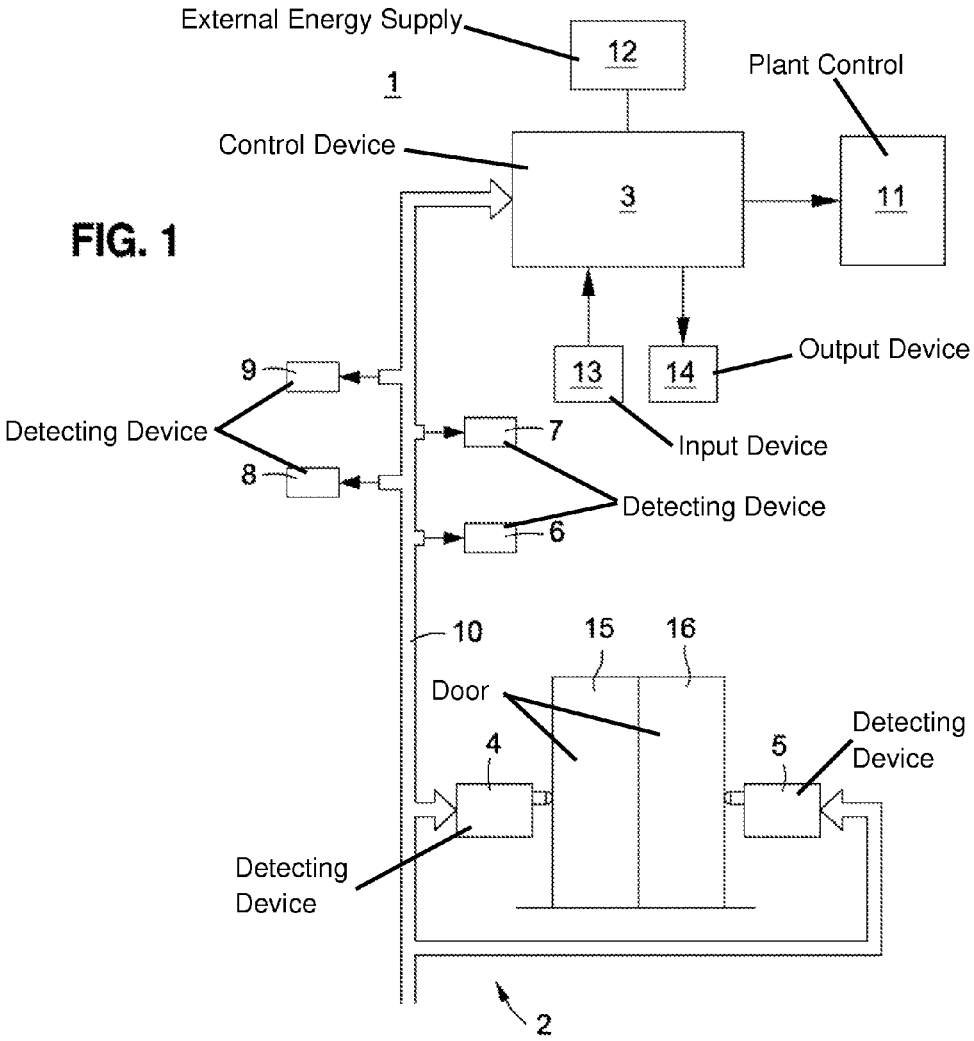
FIG. 1 shows a passenger transport system with a monitoring device in a schematic illustration, in the manner of a detail, in correspondence with an embodiment of the invention.

FIG. 1 shows a passenger transport system 1, which is designed as an elevator (elevator system) 1, with a monitoring device 2 in a schematic illustration, which is in the manner of a detail, corresponding with an embodiment. In a modified form of embodiment the passenger transport system 1 can also be designed as an escalator or moving walkway.

The monitoring device 2 comprises a control device 3 and a plurality of detecting devices 4 to 9. The detecting devices 4 to 9 are connected with the control device 3 by way of a bus system 10.

The passenger transport system 1 additionally comprises a plant control 11, an external energy supply 12, which is, for example, connected with a current mains, an input device 13 and an output device 14. The external energy supply 12 can in that regard supply the detecting devices 4 to 9 with energy in parallel with the data transmission by way of the bus system 10. In addition, the external energy supply 12 supplies the control device 3, the plant control 11 and optionally the input device 13 and the output device 14 with energy, wherein the lines with respect thereto are, for simplification of the illustration, not shown. By way of example, elevator-relevant data which, for example, are relevant for maintenance can be communicated to the control device 3 by way of the input device 13. Moreover, the control device 3 can issue data, which are relevant for an operator, particularly a maintenance operative, by way of the output device 14. The control device 3 can additionally intervene in the elevator control 11. The control device 3 can thereby switch to a special operating state. In the special operating state transport by the passenger transport system 1 is then blocked. This can take place, for example, by activation of a brake, particularly a safety brake, and/or by deactivation of a drive motor.

The passenger transport system 1 comprises items of equipment 15, 16 which, in this embodiment, are formed as doors 15, 16. Such doors 15, 16 can be present at a floor of a building. When the doors 15, 16 are closed access to an elevator shaft is excluded. The items of equipment 15, 16 can be externally actuated, particularly opened, by persons. In this embodiment a possible external actuation of the device 15 is detected by the detecting device 4. A possible external actuation of the device 16 is detected by the detecting device 5.

The idea of the externally actuable items of equipment 15, 16 is in this regard to be understood generally. The items of equipment 15, 16 can also be constructed as flaps, locks, particularly three-square locks, of doors, particularly shaft doors, which are monitored. The items of equipment 15, 16 are in that case not necessarily a component of the monitoring device 2. In particular, the monitoring device 2 can also be produced and marketed independently of such items of equipment 15, 16.

The detecting devices 6 to 9 serve for monitoring further such items of equipment, which, for the sake of simplification, are not illustrated.

The items of equipment 15, 16 serving as shaft doors 15, 16 can be monitored by the detecting devices 4, 5. It can thus be established whether anybody could enter the elevator shaft. In particular, it can be monitored in the case of an elevator 1 with reduced shaft head or no shaft head whether anybody could have gone onto the car roof of the elevator car. When an external energy supply 12 is present this information can be communicated to the control device 3 directly by way of the bus system 10. In the case of interruption of the external energy supply 12 with respect to the detecting devices 4, 5 a monitoring is equally possible such as also described on the basis of FIGS. 2 to 4. Thus, the passenger transport system 1 can automatically go back to normal operation, for example after a power failure, if no external actuation of the items of equipment 15, 16 has taken place. Thus, in this embodiment an automatic return to normal travel is possible if none of the shaft doors 15, 16 has been opened in the meantime.

Figure 2:
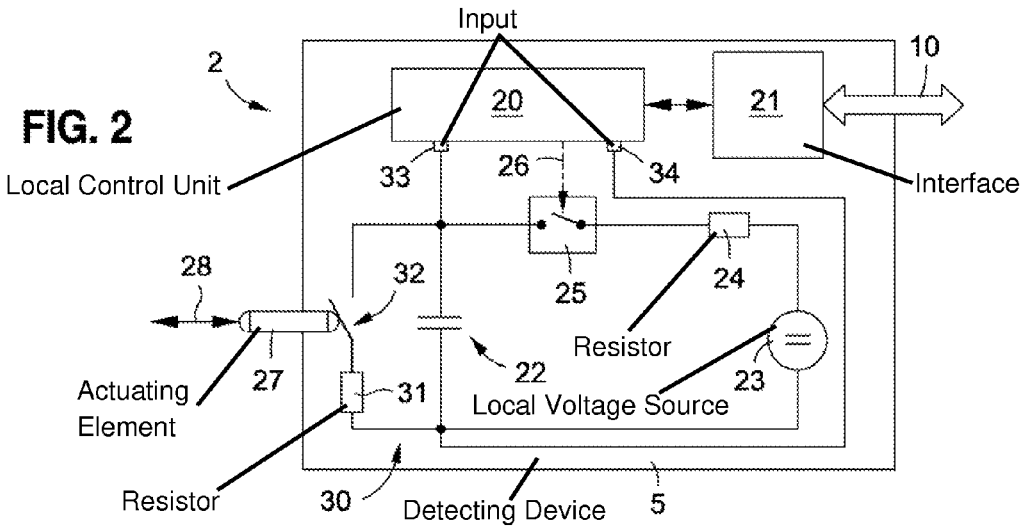
FIG. 2 shows a monitoring device of the passenger transport system illustrated in FIG. 1 in a schematic illustration, in the manner of a detail, in correspondence with a first possible embodiment of the invention.

FIG. 2 shows a monitoring device 2 of the passenger transport system 1, which is illustrated in FIG. 1, in a schematic illustration, in the manner of a detail, corresponding with a first possible embodiment of the invention. The detecting device 5 comprises a local control unit 20 and an interface 21. The local control unit 20 is in that case connected with the bus system 10 by way of the interface 21. In particular, the local control unit 20 is connected with the control device 3 when the external energy supply 12 is available. The local control unit 20 can then itself be supplied with power from the present external energy supply 12.

The detecting device 5 has an energy store 22 for storage of electrical energy. In this embodiment the energy store 22 is formed by a condenser 22. In addition, a local voltage source 23 serving as a charging source 23 is present. The local voltage source 23 can thus depend on the external energy supply 12. If the external energy supply 12 is interrupted, then in this case the local voltage source 23 is also without function. The local voltage source 23 can obviously also be a battery or an accumulator. In addition, a resistor 24 and a switching element 25 are provided. The switching element 25 is actuable by the local control unit 20 as is clarified by the dashed-line arrow 26. When the switching element 25 is closed the energy store 22 is charged by the local voltage source 23 via the resistor 24.

After the charging, the switching element 25 can be opened again. The energy store 22 can thereby, when the external energy supply 12 is in fact, be kept in the charged state. In a given case the energy store 22 can also be kept in the charged state in that the switching element 25 is kept closed when the external energy supply 12 is present. A closing, which takes place at a specific spacing, of the switching element 25 is also possible in order to further compensate for a possible loss of charge of the energy store 22 as long as the external energy supply 12 is present.

If the external energy supply 12 is interrupted and/or an actuating element 27 is actuated then the switching element 25 is opened insofar as the switching element 25 should still not happen to be in an opened state.

In this embodiment a pin-shaped mechanical actuating element 27 is provided. The pin-shaped mechanical actuating element 27 is in that case actuable by the device 16, as is indicated by the double arrow 28. For example, the actuating element 27 can be adjusted by opening of the door 16. Correspondingly, the actuating element 27 can also be adjusted by opening of a lock, particularly a three-square lock.

The detecting device 5 further comprises a current circuit 30, which is formed from the energy store 22, a resistor 31 and a mechanically actuable switching element 32. The mechanically actuable switching element 32 can be formed as, in particular, a button 32. When the actuating element 27 closes the button 32 the energy store is then, if the switching element 25 is open, discharged. In addition, when the actuating element 27 is reset again the energy store 22 remains discharged, since the switching element 25 is open and the voltage source 23 is therefore without function. This principle of functioning is independent of whether the external energy supply 12 is present or interrupted. However, it is a particular advantage of the invention that detection of actuation of the actuating element 27 is possible even when the external energy supply 12 is interrupted. When the interruption of the external energy supply 12 ends, the local voltage source 23 is then indeed again in operation, but the switching element 25 remains open. The energy store 22 is thus kept in the discharged state.

The local control unit 20 has inputs 33, 34, by way of which the state of the energy store 22 can be detected or read out. If a possible actuation of the actuating element 27 is to be interrogated, for example when the external energy supply 12 is reinstated, the control device 3 then interrogates the state of the energy store 22 from the local control unit 20 by way of the bus system 10. If the local control unit 20 reports a discharged state of the energy store 22 the control device 3 then blocks, by way of the plant control 11, possible transport of persons.

Thus, in the case of interruption of the external energy supply 12 the energy store 22 is transferred to a discharged state if the detecting device 5 detects external actuation of the device 16. If the energy store 22 after the interruption of the external energy supply 12 is then in the discharged state the control device 3 then subsequently switches to the special operating state. This special operating state can be indicated by way of the output device 14 to an operator, particularly a service engineer. Resetting can then be requested by way of the input device 13.

However, the control device 3 transfers the energy store 22, when the external energy supply 12 is present, from the discharged state to the charged state only if the detecting device 5 no longer detects the external actuation of the device 16. This means that the door 16 is closed again or a lock associated with the door 16 is locked again. In addition, a manual release has to be carried out by the service engineer so that the control device 3 transfers the energy store 22 from the discharged state to the charged state.

In this embodiment manual release takes place by means of the input device 13. The manual release is communicated by the control device 3 to the local control unit 20. In addition, in this embodiment the energy store 22 can, for reasons of construction, be transferred to the charged state only if the current circuit 30 is opened again. If the switching element 32 is opened and at the same time the local control unit 20 closes the switching element 25, then the energy store 22 is charged by the local voltage source 23. Logically, charging of the energy store 22 takes place only when the passenger transport system 1, when the external energy supply 12 is present and after predetermined checks have been carried out, is transferred by authorized personnel from the special operating state to a normal operating state.

The local control unit 20 can additionally monitor charging of the energy store 22 by way of the inputs 33, 34. In that case, it is possible to predetermine for the energy store 22 a threshold value above which the energy store 22 is charged.

In this embodiment the mechanically actuable switching element 32 designed as a button 32 is a passive switching element 32.

Figure 3:
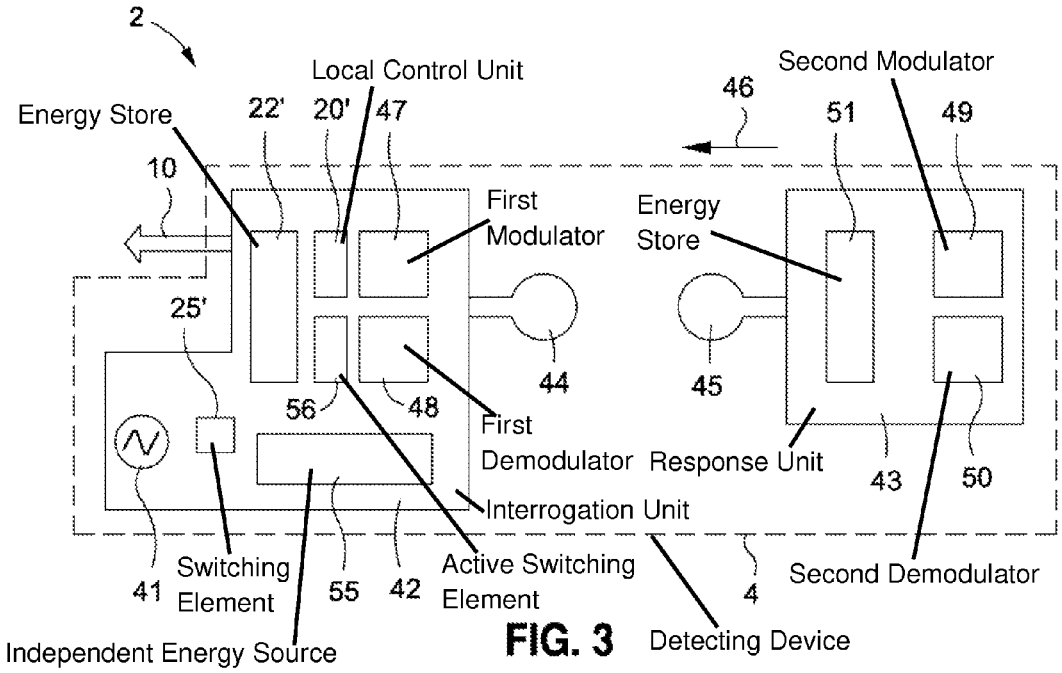
FIG. 3 shows a monitoring device of the passenger transport system illustrated in FIG. 1 in a schematic illustration, in the manner of a detail, in correspondence with a second possible embodiment of the invention in a non-actuated state of an device of the passenger transport system.

FIG. 3 shows a monitoring device 2 of the passenger transport system 1, which is illustrated in FIG. 1, in a schematic illustration in the manner of a detail corresponding with a second possible embodiment, in a non-actuated state of the device 15 of the passenger transport system 1. The detecting device 4 of the monitoring device 2 in this embodiment comprises an active unit 42 constructed as an interrogation unit 42 and a passive unit 43 constructed as a response unit 43. The response unit 43 can be, for example, a transponder, a tag, a smart card or a chip card. The interrogation unit 42 comprises a first coil 44. The response unit 43 comprises a second coil 45. The interrogation unit 42 and the response unit 43 are in a rest state when the device 15 is not actuated. In the rest state the interrogation unit 42 and the response unit 43 are so far apart from one another that no interaction takes place. In this embodiment a possible interaction takes place by way of an electromagnetic coupling. Thus, in the rest state there is an insufficient electromagnetic coupling between the coils 44, 45.

The operation mode of the monitoring device 2 in correspondence with the second possible embodiment is described in the following also with reference to FIG. 4.

Figure 4:
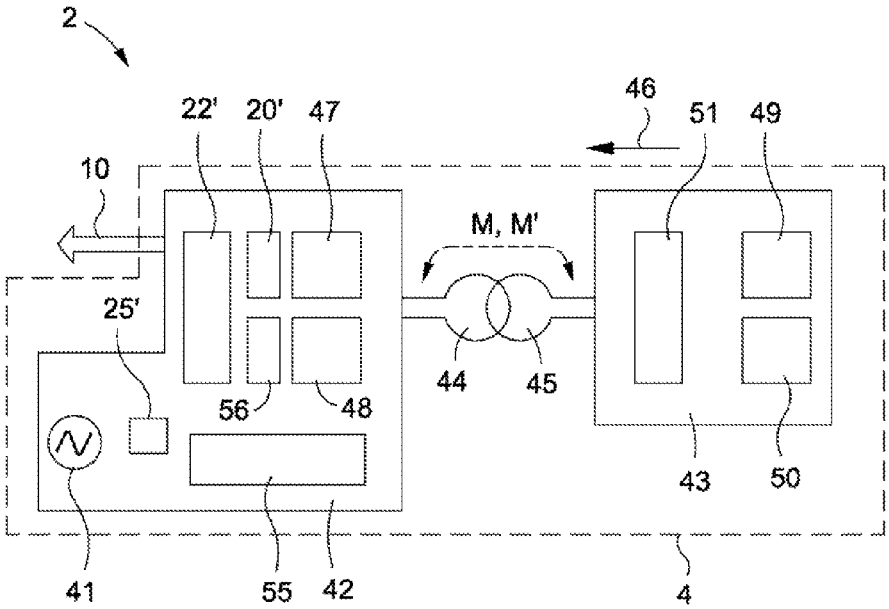
FIG. 4 shows the monitoring device illustrated in FIG. 3 in an externally actuated state of the device of the passenger transport system.

FIG. 4 shows the monitoring device 2, which is illustrated in FIG. 3, in an externally actuated state of the device 15 of the passenger transport system 1. Since the device 15 is in an externally actuated state an adjustment of the response unit 43 relative to the state illustrated in FIG. 3 takes place. Specifically, the response unit 43 can be adjusted in a direction 46 towards the interrogation unit 42. As a result, the first coil 44 of the interrogation unit 42 and the second coil 45 of the response unit 43 are disposed so close to one another that an interaction is possible. An electromagnetic coupling between the coils 44, 45 is thus present.

In this embodiment the interrogation unit 42 comprises a first modulator 47 and a first demodulator 48. In addition, a generator 41 is provided, which can be designed as, for example, a high-frequency generator 41 or a radio-frequency generator 41. The response unit 43 comprises a second modulator 49 and a second demodulator 50. In addition, the response unit 43 comprises an energy store 51, which is formed by, for example, a condenser 51. The response unit 43 therefore preferably manages without an individual energy supply, such as a battery.

The interrogation unit 42 is in a position of transmitting information to the response unit 43 and obtaining information from the response unit 43. The coils 44, 45 in that case serve as antennae 44, 45. The interrogation unit 42 transmits energy to the response unit 43 by way of an electromagnetic field. This takes place via an electromagnetic coupling, which functions similarly to a transformer, in which the energy is transmitted from a primary winding through a narrow coupling to a secondary winding. The response unit 43 temporarily stores the energy, which is coupled in by way of the electric magnetic field, in the energy store 51. As soon as the response unit 43 has received sufficient energy it is functionally capable and responds in specific manner to a pattern M generated by the interrogation unit 42.

The pattern M, which is generated by the interrogation unit 42, as well as an answer M' can be, for example, numbers, which are illustrated by a pattern. The pattern M exciting the response unit 43 does not in this case have to be very complex, since it primarily serves for transmission of energy and thus for triggering the answer M'. In one possible embodiment the pattern M can be a phase-modulated high-frequency signal. The pattern M is preferably used by the response unit 43 merely for obtaining energy and for synchronization of an answer. Thus, the pattern M can be understood as an instruction to the response unit 43 to generate a corresponding answer M'.

A causal link of the answer M' and the question M can thus be ensured.

The response unit 43 can change the pattern M in such a manner that it is ensured that the change takes place through the response unit 43 itself and not through another element. For example, the response unit 43 can answer a question M by the transmission of a unique number M'. A unique identification of the response unit 43 is thus possible.

Thus, it is possible to unambiguously distinguish between an unactuated state of the device 15 and an externally actuated state of the device 15.

In one possible embodiment the interrogation unit 42 of the detecting device 4 comprises an independent energy source 55 which is independent of the external energy supply 12. The independent energy source 55 can therefore supply the interrogation unit 42, which is designed as an active unit 42, with energy even in the case of interruption of the external supply 12. In particular, the generator 41, first modulator 47 and first demodulator 48 can thus be supplied with energy.

The response unit 43, which is designed as a passive unit 4, thereagainst does not need any independent energy source. The independent energy source 55 can be formed by, for example, a battery 55 or an accumulator 55. Thus, in a given case charging of the independent energy source 55 by way of the external energy supply 12 is possible in usual operation.

The interrogation unit 42 comprises a local control unit 20' and an active switching element 56. The active switching element 56 can comprise at least one transistor. If the external energy supply 12 is interrupted then the local control unit 20' and the active switching element 56 can be supplied by the independent energy source 55.

If an externally actuated adjustment of the device 15 takes place then the coils 44, 45 go into a spacing in which an electromagnetic coupling is possible, as is illustrated in FIG. 4. Through the exchange of the patterns M, M' it is detected that an external actuation of the device 15 has taken place. The local control unit 20' thereupon switches the active switching element 56 so as to discharge the energy store 22'.

After the interruption of the external energy supply 12 the control device 3 reads out the state of the energy store 22' by way of the local control unit 20'. The control device 3 can thus establish whether or not external actuation of the device 15 took place during the interruption of the external energy supply 12.

Subsequently, the energy store 22' can under specific conditions be shifted back into the charged state as is described on the basis of FIG. 2. For that purpose the local control unit 20' can switch the switching element 25'. Charging of the energy store 22' can take place at least indirectly by way of the external energy supply 12.

In a modified embodiment it is also possible to eliminate the independent energy source 55 of the interrogation unit 42. The energy supply of the interrogation unit 42, which is an active unit 42, can in that case be taken over by the energy store 22'. For that purpose the energy store 22' can, for example, be discharged to below a threshold value, wherein this threshold value is selected to be of such a height that even under the threshold value a sufficient energy supply of the interrogation unit 42 is still guaranteed. The discharged state of the energy store 22' is then to be understood as discharged only with respect to the threshold value and not with respect to a possible energy supply of the interrogation unit 42.

In a further possible embodiment the energy store 22' can equally serve for energy supply of the interrogation unit 42. However, the active switching element 56 is in that case designed so that when the active switching element 56 is closed a progressive discharging of the energy store 22' takes place. The energy store 22' can then also be discharged to such an extent that when the external energy supply 12 is interrupted the interrogation unit 42 is no longer functionally capable as a consequence of a lack of sufficient energy supply. If the external energy supply 12 is then reinstated then the discharged state of the energy store 22' can nevertheless be read out.

In a further possible embodiment the energy supply of the interrogation unit 42 of the detecting device 4 can also be ensured partly by way of the energy store 22' and partly by way of the independent energy source 55.

The active switching element 56 can thus be electromagnetically actuated at least indirectly. The electromagnetic actuation takes place, in the case of the embodiments described on the basis of FIGS. 3 and 4, by the electromagnetic coupling. In corresponding manner, an electrical or electronic actuation of the active switching element 56 of the detecting device 4 can also take place at least indirectly when an external actuation of the device 15 takes place with the external energy supply 12 interrupted.

The manner of functioning of a bistable switch can thus be realized by way of the energy store 22, 22' locally at every detecting device 4 to 9. After an interruption of the external supply 12 a central interrogation by the control unit 3 is possible by way of the bus system 10. The control device 3 can thus guarantee central monitoring. As soon as at least one of the detecting devices 4 to 9 detects external actuation this—represented by a discharged energy store 22, 22'—is initially stored locally at the respective detecting device 4 to 9 and then reported to the central control device 3. There can thus be intervention in the operation depending on the respective situation. Independently of that, monitoring by the detecting device 4 to 9 can be guaranteed even when the external energy supply 12 is present. The control device 3 can, for example, decide in situation-dependent manner that stopping does not take place, that a safety brake is activated or that a rapid stop is required.

Resetting of the respective local energy store 22, 22' can be possible only in specific circumstances. For example, it can be required that all doors 15, 16 are closed. In addition, it can be required that an inspection is not ongoing. The control device 3 can centrally command resetting by way of the bus system 10. A central control by way of the input device 13 and the output device 14 and yet a local monitoring are thus possible.

In addition, a function test routine can be started by way of the input device 13. Charging and discharging operations during operating pauses or maintenance operations can, for example, be carried in such a function test routine. The energy stores 22, 22' can thereby be checked for sufficient functional capability, particularly a sufficient capacity. Also possible are a charge measurement, a charge time measurement, a voltage loss measurement and the like so as to estimate a life of the individual energy stores 22, 22'. This enables preventative maintenance.

In the case of a further possible modification the discharging of the energy store 22 can also take place by way of a resistor 31, which is designed as a warning light 31. Moreover, it is advantageous for the resistance 31 to be so dimensioned that the energy in the case of external actuation is rapidly diminished.

In the method for monitoring the passenger transport system 1 it is advantageous that in the event of interruption of the external energy supply 12 the energy store 22, 22' is transferred to a discharged state if external actuation of the device 15, 16 is detected and that after the interruption the external energy supply 12 is switched to the special operating state if the energy store 22, 22' is in the discharged state.

The invention is not restricted to the described embodiments. Thus, the most diverse safety-relevant switches of the passenger transport system, for example also car doors, access doors of engine compartments and the like, can be supplemented or monitored by the monitoring device according to the invention.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A monitoring device for transport systems for persons comprising:

a detecting device for detecting external actuation of an equipment of a passenger transport system; and an energy store for storing electrical energy, wherein the energy store is kept in an electrically charged state independently of an external energy supply for the passenger transport system, wherein the detecting device detects external actuation of the equipment and the energy store is transferred to an electrically discharged state after the external actuation of the equipment, and wherein the discharged state of the energy store represents the external actuation when the equipment has re-adopted an initial position prior to the external actuation.

2. The monitoring device according to claim 1 wherein the detecting device includes a switching element, which switching element is mechanically actuated at least indirectly by the equipment of the passenger transport system and is actuated for detection of the external actuation of the equipment, and when the switching element is actuated a current circuit is closed for discharging the energy store.

3. The monitoring device according to claim 2 wherein the switching element is a passive switching element.

4. The monitoring device according to claim 1 wherein the detecting device includes a switching element that is electrically, electronically or electromagnetically actuable at least indirectly by the equipment of the passenger transport system and is actuable for detection the external actuation of the equipment, and when the switching element is actuated a current circuit for discharging the energy store is closed.

5. The monitoring device according to claim 4 wherein the switching element is an active switching element that is supplied with energy by at least one of the energy store and an independent energy source.

6. The monitoring device according to claim 4 wherein the switching element is a switching element of an active unit of the detecting device that is supplied with energy by at least one of the energy store and an independent energy source.

7. The monitoring device according to claim 4 wherein the detecting device includes a local control unit that is supplied with energy by at least one of the energy store and an independent energy source of the detecting device, and wherein the local control unit controls the discharging, which takes place on interruption of the external energy supply and external actuation of the equipment, of the energy store whereby a residual energy of the energy store, which for switching to a special operating state counts as discharged, is still sufficient for supply of the switching element.

8. The monitoring device according to claim 1 wherein a threshold value for the energy store is predetermined and the energy store is transferable into a charged state in which the charge of the energy store is greater than the threshold value and after detection of external actuation of the equipment the energy store is transferred by a discharging process to a discharged state in which the charge of the energy store is less than the threshold value.

9. The monitoring device according to claim 8 wherein an upper threshold value and a lower threshold value for the energy store are predetermined and the upper threshold value is greater than the lower threshold value.

10. A passenger transport system, the system being one of an elevator, an escalator or a moving walkway, including a monitoring device according to claim 1 with the externally actuable equipment associated with the detecting device of the monitoring device.

11. The passenger transport system according to claim 10 with a plurality of the externally actuable equipment, at least one of the detecting device associated with each equipment, wherein the detecting devices are connected with a control device by a bus system and at least one energy store is locally arranged at each of the detecting devices.

12. A method of monitoring a passenger transport system having an externally actuated equipment comprising the steps of:

detecting external actuation of the equipment with a detecting device;

charging an energy store for storage of electrical energy to a charged state; and transferring the energy store to a discharged state when the external actuation of the device is detected, wherein the discharged state of the energy store represents external actuation when the equipment has re-adopted an initial state thereof prior to the external actuation.

13. The method according to claim 12 wherein on interruption of an external energy supply of the passenger transport system the energy store is transferred to the discharged state when the detecting device detects the external actuation of the equipment and that a control device of the passenger transport system after restoration of the external energy supply switches to a special operating state if the energy store is in the discharged state.

14. The method according to claim 13 wherein the control device connected to the external energy supply transfers the energy store from the discharged state to the charged state only if the detecting device does not detect an external actuation of the equipment.

15. The method according to claim 13 wherein the control device connected to the external energy supply transfers the energy store from the discharged state to the charged state only if the control device blocks transport of persons by the passenger transport system in the special operating state and manual release of the equipment is carried out.

* * * * *